US008464886B2

(12) United States Patent
Fisher

(10) Patent No.: US 8,464,886 B2
(45) Date of Patent: Jun. 18, 2013

(54) TAMPER-EVIDENT CLOSURE

(75) Inventor: Scott L. Fisher, Evansville, IN (US)

(73) Assignee: Berry Plastics Corporation, Evansville, IN (US)

( * ) Notice: Subject to any disclaimer, the term of this patent is extended or adjusted under 35 U.S.C. 154(b) by 289 days.

(21) Appl. No.: 12/832,809

(22) Filed: Jul. 8, 2010

(65) Prior Publication Data

US 2011/0139783 A1 Jun. 16, 2011

Related U.S. Application Data

(60) Provisional application No. 61/286,739, filed on Dec. 15, 2009.

(51) Int. Cl.
*B65D 17/34* (2006.01)
*B65D 51/18* (2006.01)

(52) U.S. Cl.
USPC ..... 220/254.2; 220/254.3; 220/270

(58) Field of Classification Search
USPC ..... 220/254.2, 254.3, 259.2, 259.1, 270, 220/375
See application file for complete search history.

(56) References Cited

U.S. PATENT DOCUMENTS

| | | | | |
|---|---|---|---|---|
| 3,187,964 | A * | 6/1965 | Foster | 222/480 |
| 3,675,812 | A | 7/1972 | Foster | |
| 4,463,869 | A * | 8/1984 | Lewis | 220/269 |
| 4,592,480 | A | 6/1986 | Hart et al. | |
| 4,610,371 | A | 9/1986 | Karkiewicz | |
| 4,621,744 | A | 11/1986 | Foster | |
| 4,658,980 | A * | 4/1987 | Lindstrom | 220/214 |
| 4,921,744 | A | 5/1990 | Mitsui et al. | |
| 5,052,572 | A | 10/1991 | Pherigo | |
| 5,219,087 | A | 6/1993 | Christensson | |
| 6,422,411 | B1 | 7/2002 | Gray | |
| 6,644,491 | B2 | 11/2003 | Nally et al. | |
| D495,256 | S | 8/2004 | Solowiejko | |
| 6,886,708 | B2 | 5/2005 | Kaufman et al. | |
| 7,021,482 | B2 | 4/2006 | Solowiejko | |
| 7,114,627 | B2 | 10/2006 | Solowiejko | |
| D539,647 | S | 4/2007 | Solowiejko | |
| 7,261,217 | B2 | 8/2007 | Solowiejko | |
| 7,303,088 | B2 | 12/2007 | Sawyer et al. | |
| 7,845,519 | B2 * | 12/2010 | Newberry et al. | 222/153.07 |
| 8,113,377 | B2 * | 2/2012 | Solowiejko | 220/359.2 |
| 2004/0226950 | A1 * | 11/2004 | Samz et al. | 220/254.2 |
| 2005/0040168 | A1 * | 2/2005 | Solowiejko | 220/254.2 |
| 2006/0118556 | A1 * | 6/2006 | Solowiejko | 220/254.2 |
| 2006/0144874 | A1 * | 7/2006 | Solowiejko | 222/480 |
| 2007/0056972 | A1 | 3/2007 | Solowiejko | |
| 2007/0215619 | A1 | 9/2007 | Solowiejko | |
| 2008/0047976 | A1 | 2/2008 | Scheer et al. | |
| 2008/0264961 | A1 | 10/2008 | Sawyer | |
| 2009/0101645 | A1 | 4/2009 | Wilson et al. | |
| 2009/0101647 | A1 | 4/2009 | Newberry et al. | |
| 2009/0101674 | A1 | 4/2009 | Newberry et al. | |

* cited by examiner

*Primary Examiner* — Mickey Yu
*Assistant Examiner* — Niki Eloshway
(74) *Attorney, Agent, or Firm* — Barnes & Thornburg LLP

(57) ABSTRACT

A container closure includes a body that is adapted to mount on an underlying container to cover a mouth opening into an interior region formed in the container. The container closure further includes flip-top caps mounted for movement relative to the body to open and close dispensing apertures formed in the body. The container closure also includes a tamper band coupled to the flip-top caps and to the body until a consumer opens the flip-top caps for the first time.

19 Claims, 6 Drawing Sheets

TAMPER-EVIDENT CLOSURE

PRIORITY CLAIM

This application claims priority under 35 U.S.C. §119(e) to U.S. Provisional Application Ser. No. 61/286,739, filed Dec. 15, 2009, which is expressly incorporated by reference herein.

BACKGROUND

The present disclosure relates to closures for mounting on the top of containers, and in particular, to a container closure including a flip-top cap. More particularly, the present disclosure relates to a tamper-evident indicator associated with several flip-top caps arranged to lie in side-by-side relation and included in a container closure.

SUMMARY

In accordance with the present disclosure, a container closure is provided for coupling with a container to produce a package. The container closure comprises a body adapted to be coupled to the container and a lid movable relative to the body to cover and uncover dispensing apertures formed in the body and arranged to open into an interior region formed in the container.

In illustrative embodiments, the lid includes three flip top caps. The container closure also includes a lid tether configured to couple each of the flip-top caps to the body for pivotable opening and closing movement relative to the body by a consumer. Each of the flip-top caps can be moved by a consumer to open or close a companion dispensing aperture formed in the body to communicate with an interior region formed in the container to hold spices or other dispensable materials.

In illustrative embodiments, the lid further includes a cap-motion blocker comprising a removable tamper band and frangible connectors coupling the removable tamper band to free ends of each of the flip-top caps when the container closure is molded. At a factory, the lid is pivoted toward the body on the lid tether (before or after the container closure is mounted on a container) to cause band and retainers included in the tamper band to mate with a retainer anchors included in the body without breaking the frangible connectors coupling the tamper band to the flip-top caps to produce a manufactured, assembled, ready-for-sale configuration. The tamper band is coupled to each of the flip-top caps and the body to establish a tamper-evident feature of the container closure.

In illustrative embodiments, a consumer pulls on one end of the tamper band to cause the frangible connectors to break and cause the band retainers included in the tamper band to disengage retainer anchors included in the body so that the tamper band can be removed from the body and flip-top caps. This removal frees the flip-top caps to be moved by the consumer relative to the body on the lid tether (e.g. living hinges—one for each flip-top cap) between opened and closed positions. Each flip-top cap cooperates with the body to include suitable means for releasably retaining the flip-top cap normally in a closed position closing one or more of the dispensing apertures formed in the body.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
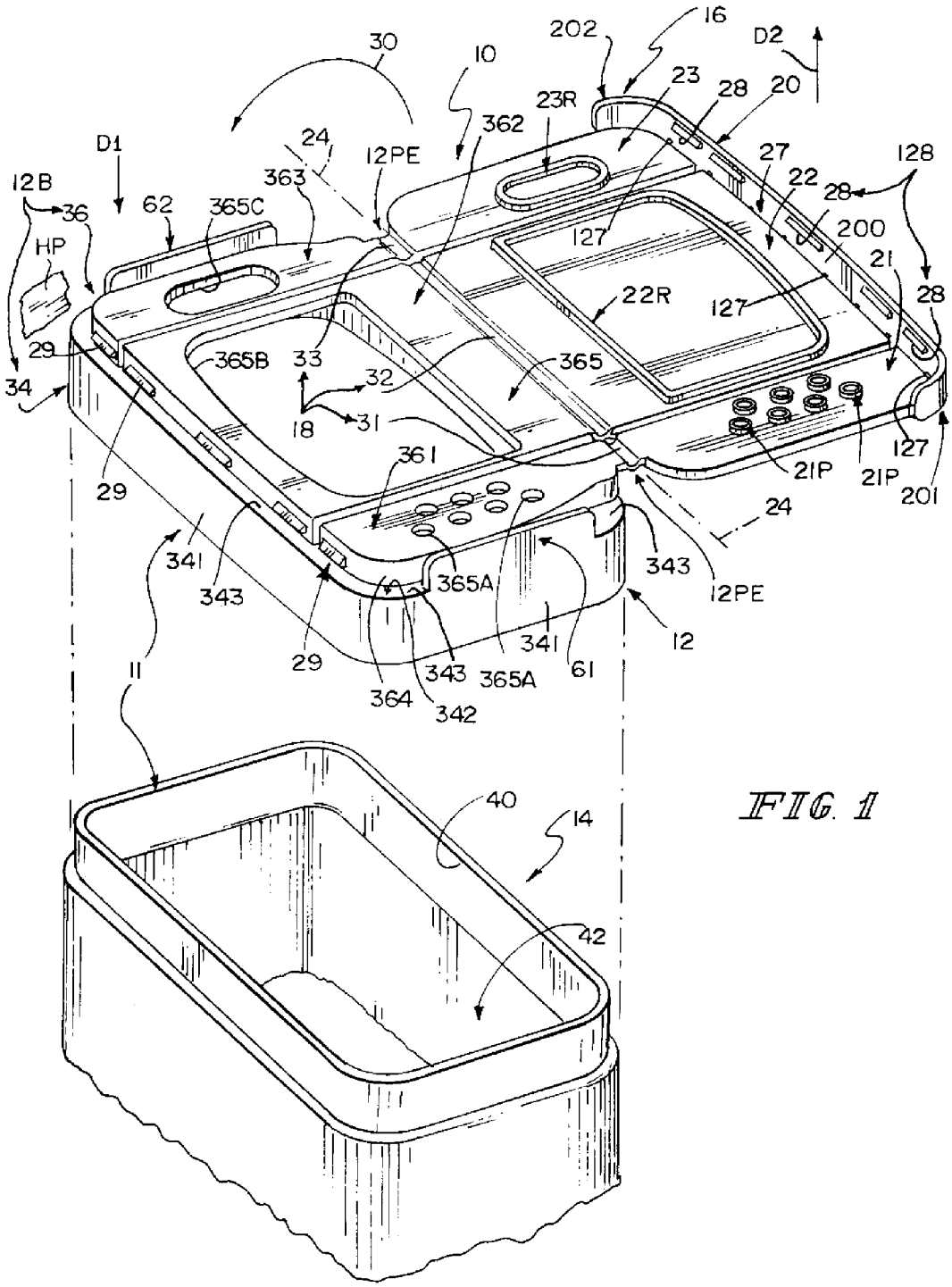
FIG. 1 is a perspective assembly view of a closure in accordance with a first embodiment of the present disclosure showing that the closure includes a body adapted to be mounted on an underlying container, a lid including a series of three separate flip-top caps and a removable tamper band coupled by a series of frangible connectors to free ends of each of the flip-top caps, and a lid tether including a separate hinge for interconnecting each of the flip-top caps to the body to support each flip-top cap for free and independent pivotable movement relative to the body about a pivot axis at the option of a user once the removable tamper band has been separated from the three flip-top caps and disengaged from a series of outwardly projecting retainer anchors coupled to a front portion of the body as suggested in FIGS. 3 and 4.

A container closure 10 includes a body 12 that is adapted to mate with a container 14 and a lid 16 including a removable tamper band 20, a series of three separate flip-top caps 21, 22, 23, and a frangible link 27 interconnecting removable tamper bond 20 and flip-top caps 21, 22, 23 as suggested in FIG. 1. Container closure 10 also includes a lid tether 18 interconnecting body 12 and lid 16 and establishing a pivot axis 24 as shown in FIG. 1. In an illustrative embodiment, lid tether 18 including a first hinge 31 connecting body 12 to first flip-top cap 21, a second hinge 32 connecting body 12 to second flip-top cap 22, and a third hinge 33 connecting body 12 to third flip-top cap 23 is shown, for example, in FIG. 1. Another embodiment of a container closure 110 in accordance with the present disclosure is illustrated in FIGS. 7-12. Container closures 10, 110 are well-suited for use with containers used to store spices.

Figure 2:
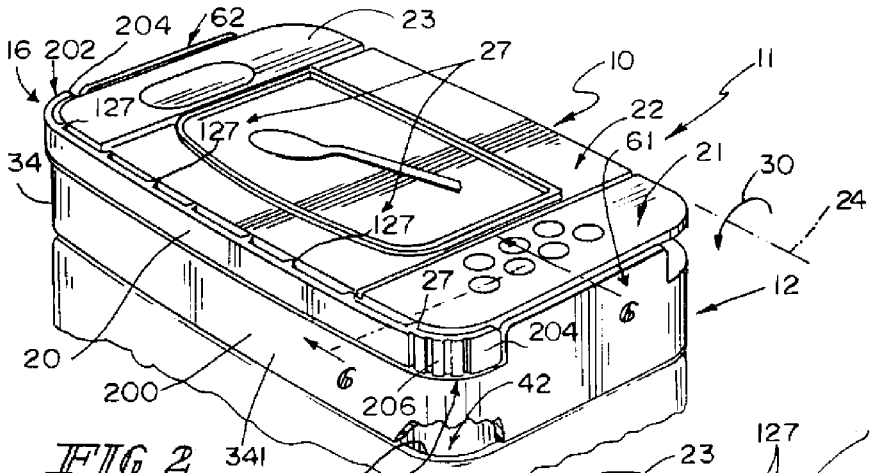
FIG. 2 is a perspective view of a package including the closure and container of FIG. 1 in a manufactured, assembled, and ready-for-sale configuration after the lid shown in FIG. 1 has been pivoted about a pivot axis on the three hinges established by the lid tether in a counterclockwise direction at a factory during manufacture of the closure to cause the lid to move from the unassembled spread-apart body-disengaging position shown in FIG. 1 to the assembled tamper-resistant body-engaging position shown in FIG. 2.

At a factory, lid 16 remains intact from the time container closure 10 is made as suggested in FIG. 1 until lid 16 is mounted on a container 14 as suggested in FIG. 2. Tamper band 20 is removed as suggested in FIG. 3 the first time a user desires to access the contents of container 14 to free flip-top caps 21, 22, 23 to be opened as suggested in FIG. 4. Lid 16 is pivoted on lid tether 18 about pivot axis 24 to move from an (as molded) unassembled spread-apart body-disengaging position shown in FIG. 1 to an assembled tamper-resistant body-engaging position shown in FIG. 2. To access contents (e.g., spice) of container 14 at first use, a consumer 26 will remove tamper band 20 from flip-top caps 21, 22, 23 by breaking a frangible link 27 comprising, for example, frangible connectors 127 provided between tamper band 20 and flip-top caps 21, 22, 23 and disengaging band retainers 28 included in tamper band 20 from companion retainer anchors 29 included in body 12 as suggested in FIGS. 3 and 4 to free each of flip-top caps 21, 22, 23 to move about pivot axis 24 between closed and opened positions relative to body 12.

As suggested in FIG. 1, each of first, second, and third flip-top caps 21, 22, and 23 is located between and coupled to lid tether 18 and removable tamper band 20 after container closure 10 is molded and before the lid 16 comprising removable tamper band 20, flip-top caps 21, 22, and 23, and frangible link 27 is pivoted about pivot axis 24 in counterclockwise direction 30 to reach the assembled tamper-resistant body-engaging position shown in FIG. 2. As suggested in FIG. 1, removable tamper band 20 is arranged to lie in spaced-apart relation to body 12 and to first, second, and third hinges 21, 22, and 23 included in lid tether 18 when container closure 10 is molded to cause body 12, lid 16, and lid tether 18 to cooperate to form a monolithic component made of a plastics material and to cause lid 16 to lie in the unassembled spread-apart body-disengaging position shown in FIG. 1. In illustrative embodiments, removable tamper band 20 is not arranged to interconnect body 12 and flip-top caps 21, 22, and 23 when container closure 10 is molded as shown in FIG. 1 until after lid 16 has been pivoted in counterclockwise direction 30 about pivot axis 24 to alter container closure 10 to assume the manufactured, assembled, ready-for-sale configuration shown in FIG. 2.

Body 12 of container closure 10 includes a foundation 34 adapted to mate with an underlying container 14 (of any suitable size and shape) and a top deck 36 coupled to foundation 34 and lid tether 18 as shown, for example, in FIG. 1. In an illustrative embodiment, a series of retainer anchors 29 included in body 12 are appended to top deck 36 as suggested in FIG. 1 and arranged to mate with companion band retainers 28 included in removable tamper band 20 as suggested in FIGS. 3 and 6 (when lid 16 is pivoted in counterclockwise direction 30 about pivot axis 24 as suggested in FIG. 1) to establish means for temporarily retaining flip-top caps 21, 22, 23 in lid 16 in closed positions covering dispensing apertures 365A, 365B, and 365C formed in top deck 36 and shown, for example, in FIG. 1.

Figure 6:
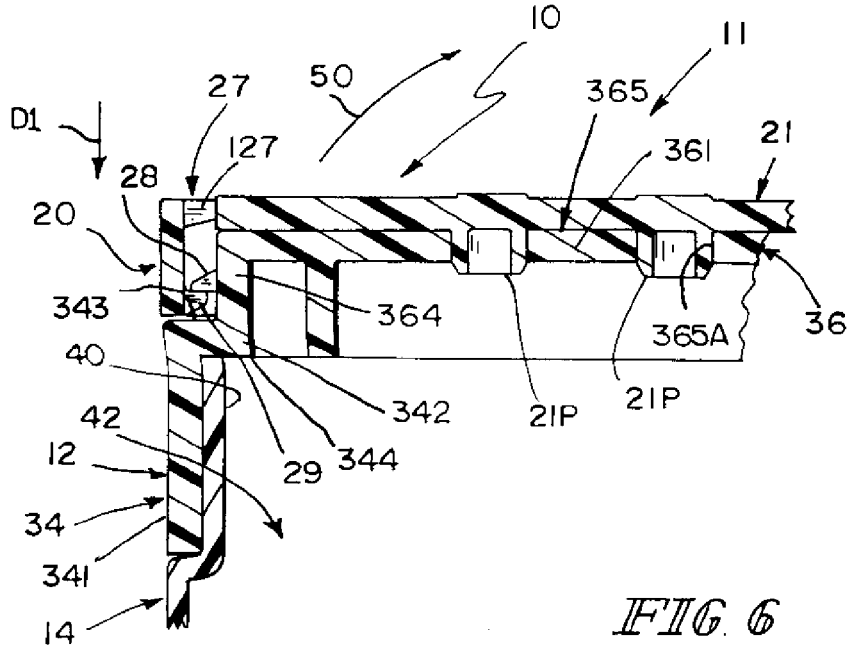
FIG. 6 is an enlarged partial sectional view taken along line 6-6 of FIG. 2 showing an interference fit between each of two downwardly extending plugs included in the first flip-top cap and a companion rim bordering one of the dispensing apertures formed in the body.

Foundation 34 of body 12 includes an endless side wall 341 adapted to mate with underlying container 14 as suggested in FIGS. 2 and 6 so as to support body 12 in a position covering a mouth 40 formed in container 14 and configured to open into an interior region 42 formed in container 14 as suggested in FIGS. 1, 2, and 6. Foundation 34 also includes a rim 342 coupled to a top portion of endless side wall 341 and arranged to extend inwardly to mate with top deck 36 and overlie a portion of interior region 42 of container 14 as shown, for example, in FIG. 6. Rim 342 is an endless element in an illustrative embodiment and includes upwardly and downwardly facing surfaces 343, 344 as shown in FIGS. 1, 4, and 6.

Figure 4:
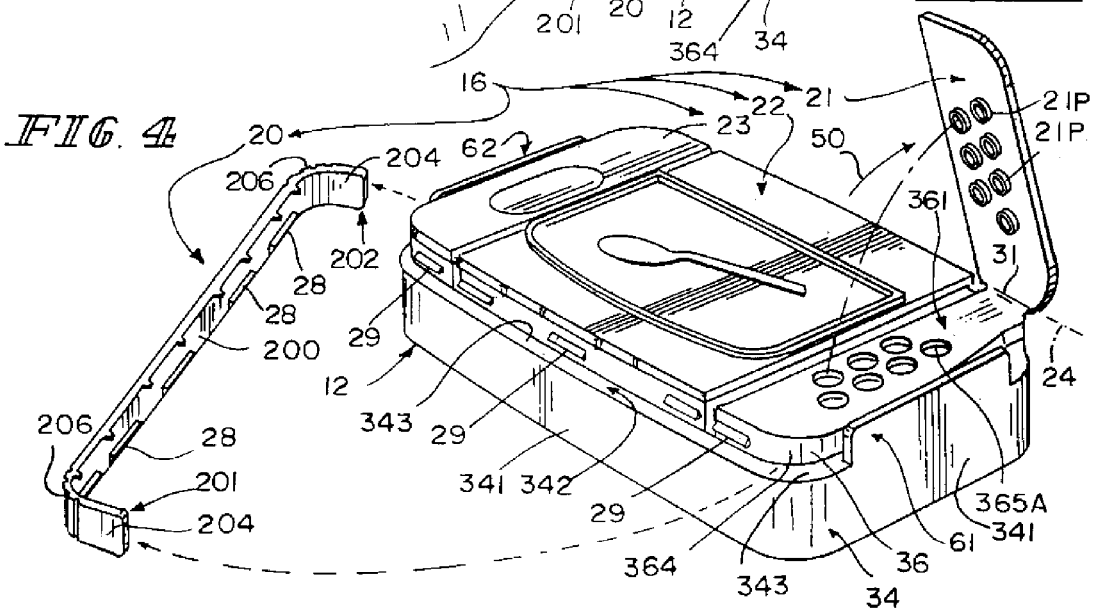
FIG. 4 is a perspective view similar to FIGS. 2 and 3 showing the removable tamper band after it has been removed completely from the three flip-top caps following breakage of all of the frangible connectors coupled to the removable tamper band and the flip-top caps and disengagement of the inwardly extending band retainers in the removable tamper band from companion outwardly projecting retainer anchors coupled to the body.

Top deck 36 of body 12 is coupled to rim 342 of foundation 34 in an illustrative embodiment shown, for example, in FIGS. 1, 4, and 6. Top deck 36 includes an upright perimeter wall 364 and a platform 365 coupled to a top portion of upright perimeter wall 364. Platform 365 is arranged to lie in closely confronting relation to the undersides of first, second, and third flip-top caps 21, 22, 23 when those caps 21, 22, 23 are moved to assume their closed positions as suggested in FIGS. 1 and 2.

Top deck 36 of body 12 is formed to include a first deck section 361 in which a portion of platform 365 is formed to include several sprinkle-discharge dispensing apertures 365A as suggested in FIG. 1. Sprinkle-discharge dispensing apertures 365A are closed when first flip-top cap 21 is moved to assume the closed position as suggested in FIGS. 2, 3, and 6 and are opened when first flip-top cap 21 is moved to assume the opened position as suggested in FIGS. 1 and 4. Container closure 10 is mounted on container 14 to place dispensing apertures 365A in fluid communication with interior region 42 of container 14.

Top deck 36 of body 12 is also formed to include a second deck section 362 in which a portion of platform 365 is formed to include a large scoop-receiver dispensing aperture 365B as suggested in FIG. 1. Scoop-receiver dispensing aperture 365B is closed when second flip-top cap 22 is moved to assume the closed position as suggested in FIGS. 2 and 3 and is opened when second flip-top cap 22 is moved to assume the opened position as suggested in FIG. 1. Dispensing aperture 365B is arranged to lie in fluid communication with interior region 42 of container 14.

Top deck 36 of body 12 is also formed to include a third deck section 363 in which a portion of platform 365 is formed to include a relatively smaller pour-discharge dispensing aperture 365C as suggested in FIG. 1. Pour-discharge dispensing aperture 365C is closed when third flip-top cap 23 is moved to assume the closed position as suggested in FIGS. 2 and 3 and is opened when third flip-top cap 23 is moved to assume the opened position as suggested in FIG. 1. Dispensing aperture 365C is arranged to lie in fluid communication with interior region 42 of container 14

As suggested in FIG. 1, second deck section 362 is arranged to lie between first and third deck sections 361, 363. Similarly, second flip-top cap 22 is arranged to lie between first and third flip-top caps 21, 23 as suggested in FIG. 1. Once a consumer 26 removes tamper band 20 as suggested in FIG. 4, consumer 26 is free to move first, second, and third flip-top caps 21, 22, 23 relative to top deck 36 of body 12 and to one another between opened and closed positions.

Lid 16 further includes a series of plugs 21P appended to the underside of first flip top cap 21 as suggested in FIGS. 1 and 4. Each plug 21P is configured to extend into a companion one of the sprinkle-discharge dispensing apertures 365A formed in first deck section 361 to close those apertures 365A when first flip-top cap 21 is moved to assume the closed position. As suggested in FIG. 6, the external diameter of each plug 21P is slightly larger than the internal diameter of each companion aperture 365A and each plug 21P is made of an elastic material to cause each plug 21P to establish an interference fit with the deck border defining a companion aperture 365A to provide interference-fit means for releasably retaining first flip-top cap 21 in the closed position as suggested in FIG. 6. To open first flip-top cap 21, consumer 26 moves cap 21 about pivot axis 24 in clockwise direction 50 to extract plugs 21P from apertures 365A so that first flip top cap 21 is moved to assume an opened position as suggested in FIG. 4.

Lid 16 further includes a ring 22R appended to the underside of second flip-top cap 22 as suggested in FIG. 1. Ring 22R is configured to extend into scoop-receiver dispensing aperture 365B to establish an interference fit with the deck border defining dispensing aperture 365B to provide interference-fit means for releasably retaining second flip-top cap 22 in the closed position as suggested in FIGS. 2 and 3.

Lid 16 also includes a relatively smaller ring 23R appended to the underside of third flip-top cap 23 as suggested in FIG. 1. Ring 23R is configured to extend into pour-discharge dispensing aperture 365C to establish an interference fit with the deck border defining dispensing aperture 365C to provide interference-fit means for releasably retaining third flip-top cap 23 in the closed position as suggested in FIGS. 2 and 3.

Removable tamper band 20 includes an elongated band strip 200, a first finger-pull tab 201 at one end of band strip 200, and a second finger-pull tab 202 at an opposite end of band strip 200 as shown, for example, in FIGS. 1 and 4. Each finger-pull tab 201, 202 includes an end plate 204 and a flexible curved link 206 interconnecting band strip 200 and end plate 204. When container closure 10 is molded, removable tamper band 20 is arranged to cause (1) elongated band strip 200 to extend along free ends of first, second, and third flip-top caps 21, 22, 23, (2) first finger-pull tab 201 to wind around an exterior corner of first flip-top cap 21, and (3) second finger-pull tab 202 to wind around an exterior corner of third flip-top cap 23 as shown, for example, in FIG. 1.

Lid 16 also includes a frangible link 27 comprising a series of frangible connectors 127 arranged to interconnect band strip 200 of tamper band 20 and first, second, and third flip-top caps 21, 22, 23 as suggested in FIGS. 1-3 and 6. These frangible connectors 127 provide means for coupling tamper band 20 to each of first, second, and third flip-top caps 21, 22, 23 when container closure 10 is molded to assume a just-molded configuration as shown, for example, in FIGS. 1 and 6. Frangible connectors 127 are broken as suggested in FIGS. 3 and 4 when consumer 26 removes tamper band 20 to free first, second, and third flip-top caps 21, 22, 23 for pivotable opening and closing movement about pivot axis 24 relative to body 12. In an illustrative embodiment, removable tamper band 20 and frangible link 27 cooperate to form a cap-motion blocker coupled to each of first, second, and third flip-top caps 21, 22, and 23 along separate first, second, and third tear lines as suggested in FIG. 1.

Figure 3:
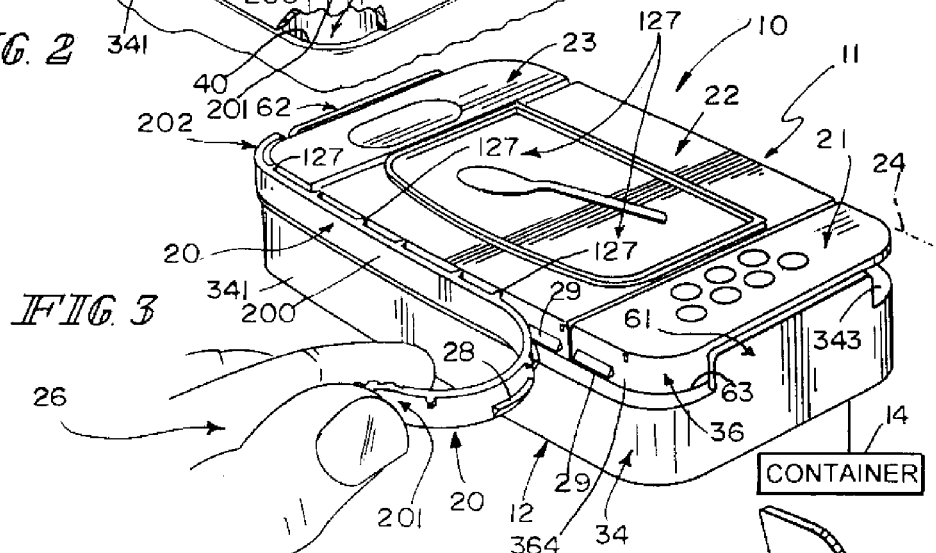
FIG. 3 is a perspective view similar to FIG. 2 showing partial removal of the removable tamper band while each of the three pivotable flip-top caps remain in closed positions covering various dispensing apertures formed in the body as shown in FIG. 1 and showing breakage of the frangible connectors linking the removable tamper band to the flip-top caps and disengagement of band retainers included in the removable tamper band from companion outwardly projecting retainer anchors coupled to the front portion of the body to free each flip-top cap for pivotable opening and closing movement about the pivot axis from a closed position on the body to an opened position away from the body.

Lid tether 18 includes (in an illustrative embodiment) a separate hinge 31, 32, 33 for interconnecting each of flip-top caps 21, 22, 23 to body 12 to support each flip-top cap 21, 22, 23 for free and independent pivotable opening and closing movement relative to body 12 about pivot axis 24 at the option of a consumer 26 once removable tamper band 20 has been separated from three flip-top caps 21, 22, 23 and disengaged from a series of outwardly projecting retainer anchors 29 coupled to an upright perimeter wall 364 of top deck 36 of body 12 as suggested in FIGS. 3 and 4.

A package 11 including closure 10 and container 14 is shown in a manufactured, assembled, and ready-for-sale configuration in FIG. 2. This configuration of container closure 10 is achieved after lid 16 has been pivoted about pivot axis 24 on three hinges 31, 32, 33 in a counterclockwise direction 30 at a factory during manufacture of closure 10 to move from the (as molded) unassembled spread-apart body-disengaging position shown in FIG. 1 to the assembled tamper-resistant body-engaging position shown in FIG. 2.

Partial removal of tamper band 20 is shown in FIG. 3 while each of the three pivotable flip-top caps 21, 22, 23 remain in closed positions covering various dispensing apertures 365A, 365B, 365B formed in top deck 36 of body 12 as shown in FIG. 1. Breakage of frangible connectors 127 linking tamper band 20 to flip-top caps 21, 22, 23 is shown in FIG. 3 along with disengagement of band retainers 28 included in removable tamper band 20 from companion outwardly projecting retainer anchors 29 coupled to upright perimeter wall 364 of top deck 36 of body 12 to free each flip-top cap 21, 22, 23 for pivotable opening and closing movement about pivot axis 24 from a closed position on body 12 to an opened position away from body 12.

Removable tamper band 20 is shown in FIG. 4 after it has been removed completely from three flip-top caps 21, 22, 23 following breakage of all of frangible connectors 127 coupled to tamper band 20 and flip-top caps 21, 22, 23 and disengagement of the inwardly extending band retainers 28 in removable tamper band 20 from companion outwardly projecting retainer anchors 29 coupled to top deck 36 of body 12. Prior to removal of tamper band 20, each band retainer 28 mates with a companion retainer anchor 29 along a lower portion of band strip 200 and under the series of frangible connectors 127 as suggested in FIGS. 3 and 6.

Figure 5:
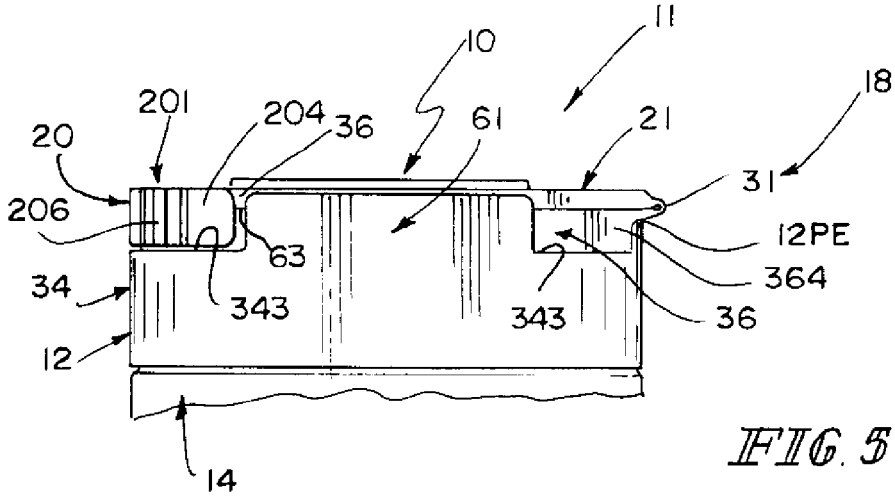
FIG. 5 is an enlarged end elevation of the closure of FIG. 1 showing one of two upright barrier flanges included in the body and showing that the upright barrier flange is arranged to extend upwardly from an underlying foundation also included in the body to cover a portion of a side-opening space formed between one of the flip-top caps and the body when that flip-top cap lies in the closed position on the body and showing that a left-hand side of the upright barrier flange is arranged to lie alongside one of the finger-pull tabs included in the tamper band.

An upright barrier flange 61 also included in body 12 is shown in FIG. 5. Upright barrier flange 61 is arranged to extend upwardly from upwardly facing surface 343 of rim 342 of underlying foundation 34 also included in body 12 as shown, for example, in FIGS. 1, 4, and 5. Upright barrier flange 61 is arranged to cover a portion of a side-opening space 63 formed between first flip-top cap 21 and top deck 36 of body 12 when flip-top cap 21 lies in the closed position on body 12 as shown best in FIG. 5. A left-hand side of upright barrier flange 61 is arranged to lie alongside one of the finger-pull tabs 201 included in tamper band 20 as shown in FIG. 5. A similar upright barrier flange 62 is arranged to lie alongside third flip-top cap 23 as suggested in FIGS. 1 and 2.

A tamper-evident closure 10 is provided for mounting on a container 14 formed to include an interior region 42 as suggested in FIGS. 1 and 2. Closure 10 includes body 12, lid 16, and lid tether 18 as suggested in FIG. 1. Body 12 is adapted to mount on container 14 to overlie interior region 42 and formed to include dispensing apertures 365A, 365B, and 365C arranged to open into interior region 42 of container 14 when body 12 is mounted on container 14. Lid 16 includes first, second, and third flip-top caps 21, 22, and 23, a removable tamper band 20, and a frangible link 27 arranged to couple removable tamper band 20 to each of flip-top caps 21, 22, 23 temporarily to define a frangible tear line between removable tamper band 20 and each of flip-top caps 21, 22, 23 as suggested in FIG. 1. Lid tether 18 is arranged to interconnect body 12 and each of flip-top caps 21, 22, 23 permanently. Lid tether 18 is configured to support each of first, second, and third flip-top caps 21, 22, 23 for independent movement relative to body 12 and to one another between a closed position (see FIG. 2) covering selected ones of the dispensing apertures 365A-C and an opened position (see FIG. 1) exposing the selected ones of the dispensing apertures 365A-C.

Removable tamper band 20 includes retainer means 128 for engaging body 12 to retain each of flip-top caps 21, 22, 23 in a temporary anchored position on body 12 covering companion dispensing apertures after movement of lid 16 from an unassembled spread-apart body-disengaging position alongside body 12 shown, for example, in FIG. 1 to an assembled tamper-resistant body-engaging position overlying body 12 shown, for example, in FIG. 2 until removable tamper band 20 is separated from flip-top caps 21, 22, 23 in response to fracture of frangible link 27 as suggested in FIGS. 3 and 4 to free each of flip-top caps 21, 22, 23 for pivoting movement about a pivot axis 24 associated with lid tether 18 between the closed and opened positions. Removable tamper band 20 is arranged to lie in spaced-apart relation to body 12 to locate first, second, and third flip-top caps 21, 22, 23 between lid tether 18 and removable tamper band 20 while lid 16 lies in the unassembled spread-apart body-disengaging position alongside body 12 as suggested in FIG. 1.

Lid tether 18 includes a first hinge 31 arranged to interconnect body 12 and first flip-top cap 21 permanently, a second hinge 32 arranged to interconnect body 12 and second flip-top cap 22 permanently, and a third hinge 33 arranged to interconnect body 12 and third flip-top cap 23 permanently as suggested in FIG. 1. Removable tamper band 20 is arranged to lie in spaced-apart relation to body 12 and to first, second, and third hinges 31, 32, 33 included in lid tether 18 when closure 10 is molded as suggested in FIG. 1 to cause body 12, lid 16, and lid tether 18 to cooperate to form a monolithic component made of a plastics material and to cause lid 16 to lie in the unassembled spread-apart body-disengaging position alongside body 12 before lid 16 is pivoted about pivot axis 24 to mate with body 12 to establish the temporary anchored positions of first, second, and third flip-top caps 21, 22, 23 on body 12.

In illustrative embodiments, first flip top cap 21 and first hinge 31 cooperate to form a first aperture cover for covering dispensing apertures 365A. Second flip-top cap 22 and second hinge 32 cooperate to form a second aperture cover for covering dispensing apertures 365B. Third flip-top cap 23 and third hinge 33 cooperate to form a third aperture cover for covering dispensing aperture 365C.

Body 12 includes a perimeter edge arranged to surround dispensing apertures 365A-C as suggested in FIG. 1. Each of first, second, and third hinges 31, 32, 33 are coupled to a rear section 12PE of the perimeter edge of body 12 as suggested in FIGS. 1 and 5.

Body 12 includes a platform 365 formed to include dispensing apertures 365A-C and lie in a horizontal plane HP as suggested in FIG. 1. Each of first, second, and third flip-top caps 21, 22, 23 include an (upwardly facing) underside arranged to lie in the horizontal plane HP (defined by platform 365) while lid 16 lies in the unassembled spread-apart body-disengaging position alongside body 12 as suggested in FIG. 1 and to lie in closely confronting relation to platform 365 while lid 16 lies in the assembled tamper-resistant body-engaging position overlying body 12 as suggested in FIG. 2.

Body 12 includes an upright perimeter wall 364 coupled to a perimeter edge of platform 365 and arranged to extend downwardly in a first direction D1 away from platform 365 and the horizontal plane HP defined by platform 365 as suggested in FIGS. 1 and 6. Removable tamper band 20 includes an elongated band strip 200 coupled to each of first, second, and third flip-top caps 21, 22, 23 by frangible link 27 as suggested in FIG. 1. Elongated band strip 200 is arranged to extend upwardly in a second direction D2 away from the undersides of first, second, and third flip-top caps 21, 22, 23 and the horizontal plane HP defined by platform 365 while lid 16 lies in the unassembled spread-apart body-disengaging position alongside body 12 as suggested in FIG. 1.

Body 12 also includes a series of retainer anchors 29 coupled to upright perimeter wall 364 as shown, for example, in FIGS. 1, 4, and 6. Retainer means 128 includes a series of band retainers 28 coupled to elongated band strip 200 as shown, for example, in FIG. 1. Each of band retainers 28 is arranged to mate with a companion retainer anchor 29 upon movement of lid 16 from the unassembled spread-apart body-disengaging position alongside body 12 as suggested in FIG. 1 to the assembled tamper-resistant body-engaging position overlying platform 365 as suggested in FIG. 2 to retain flip-top caps 21, 22, 23 in the temporary anchored positions.

Body 12 includes a base 12B formed to include dispensing apertures 365A-C and adapted to mount on container 14 in a position covering a mouth 40 formed in container 14 and configured to open into interior region 42 formed in container 14 as suggested in FIG. 1. Body 12 also includes retainer anchors 29 appended to base 12B and arranged to mate with retainer means 28 only upon movement of lid 16 from the unassembled spread-apart body-disengaging position alongside body 12 shown in FIG. 1 to the assembled tamper-resistant body-engaging position overlying body 12 shown in FIG. 2 to cover first, second, and third flip-top caps 21, 22, 23 to assume the temporary anchor positions while removable tamper band 20 is coupled to each of first, second, and third flip-top caps 21, 22, 23.

Base 12B includes a foundation 34 and a top deck 36 as suggested in FIG. 1. Foundation 34 has an endless side wall 341 and a top rim 342 coupled to an upper end of endless side wall 341. Top deck 36 is formed to include dispensing apertures 365A-C and arranged to extend upwardly away from endless side wall 341. Top rim 342 includes an outer edge coupled to endless side wall 341 and an inner edge coupled to top deck 36. Each retainer anchor 29 is cantilevered to an upright perimeter wall 364 of top deck 36 and arranged to overlie a portion of top rim 342 as suggested in FIGS. 1 and 6.

Body 12 also includes first and second upright barrier flanges 61, 62 as shown in FIGS. 1-6. Each of first and second upright barrier flanges 61, 62 is coupled to base 12B as suggested in FIG. 1. First upright barrier flange 61 is arranged to extend upwardly from top rim 342 of the underlying foundation 34 at a first end of foundation 34 to terminate at a location above top deck 36 as suggested in FIG. 5. Second upright barrier flange 62 is arranged to extend upwardly from top rim 342 of the underlying foundation 34 at an opposite second end of foundation 34 to terminate at a location above top deck 342 and to locate top deck 342 in a space provided between first and second upright barrier flanges 61, 62.

Second flip-top cap 22 is arranged to lie between first and third flip-top caps 21, 23 in an illustrative embodiment shown in FIG. 1. First, second, and third flip-top caps 21, 22, 23 are arranged to extend into the space provided between first and second upright barrier flanges 61, 62 upon movement of lid 16 to assume the assembled tamper-resistant body-engaging position overlying top deck 342 of body 12 as suggested in FIG. 2. This causes at least a portion of a space provided between a top side of top deck 342 and an underside of first flip-top cap 21 to be covered by first upright barrier flange 61. This also causes at least a portion of a space provided between the top side of top deck 342 and an underside of third flip-top cap 23 to be covered by second upright barrier flange.

Removable tamper band 20 further includes a first finger-pull tab 201 at one end of elongated band strip 200 and a second finger-pull tab 202 at an opposite end of elongated band strip 200. Elongated band strip 200 is unconnected to foundation 34 and is arranged to interconnect first and second finger-pull tabs 201, 202 and carry band retainers 28 included in removable tamper band 20. First finger-pull tab 201 is arranged to lie in close proximity to first upright barrier flange 61 and to cover another portion of the space provided between the top side of top deck 342 and the underside of first flip-top cap 21 while lid 16 lies in the assembled tamper-resistant body-engaging position overlying top deck 342 of body 12. Second finger-pull tab 202 is arranged to lie in close proximity to second upright barrier flange 62 and to cover another portion of the space provided between the top side of top deck 342 and the underside of third flip-top cap 23 while lid 16 lies in the assembled tamper-resistant body-engaging position overlying top deck 342 of body 12 a shown in FIG. 2.

Each of the first and second finger-pull tabs 201, 201 includes an end plate 204 and a flexible curved link 206 interconnecting elongated band strip 200 and end plate 204. Flexible curved link 206 of first finger-pull tab 201 winds around an exterior corner of first flip-top cap 21 while lid 16 lies in the assembled tamper-resistant body-engaging position. Flexible curved link 206 of second finger pull tab 201 winds around an exterior corner of third flip-top cap 23 while lid 16 lies in the assembled tamper-resistant body-engaging position.

Top deck 342 is located in a space provided between first and second upright barrier flanges 61, 62. First, second, and third flip-top caps 21, 22, 23 are arranged to extend into the space provided between first and second upright barrier flanges 61, 62 upon movement of lid 16 to assume the assembled tamper-resistant body-engaging position overlying top deck 342 of body 12 as shown in FIG. 2. This arrangement causes at least a portion of a side-opening space 63 provided between a top side of top deck 342 and an underside of the first flip-top cap 23 to be covered by first upright barrier flange 61 as suggested in FIG. 5 and causes at least a portion of a similar side-opening space provided between the top side of top deck 342 and an underside of the third flip-top cap 23 to be covered by second upright barrier flange 62 as suggested in FIGS. 2-4.

End plate 204 of first finger-pull tab 201 is arranged to lie in close proximity to first upright barrier flange 61 as suggested in FIG. 5 and to cover another portion of side-opening space 63 provided between the top side of top deck 342 and the underside of first flip-top cap 21 while lid 16 lies in the assembled tamper-resistant body-engaging position overlying top deck 342 of body 12. End plate 204 of second finger-pull tab 202 is arranged to lie in close proximity to second upright barrier flange 62 and to cover another portion of the similar side-opening space provided between the top side of top deck 342 and the underside of third flip-top cap 23 while lid 16 lies in the assembled tamper-resistant body-engaging position overlying top deck 342 of body 12 as suggested in FIG. 2.

In accordance with another embodiment of the disclosure illustrated in FIGS. 7-12, a three-sided removable tamper band 120 is provided. Tamper band 120 is included in a container closure 110 and is configured to function in a manner similar to removable tamper band 20 disclosed herein.

Container closure 110 includes a body 112 that is adapted to mate with a container 14. Closure 110 also includes a lid 116 including a removable tamper band 120 and three flip-top caps 121, 122, 123 and a lid tether 118 including three hinges 131, 132, 133 as shown, for example, in FIGS. 7-9 and 11.

Figure 7:
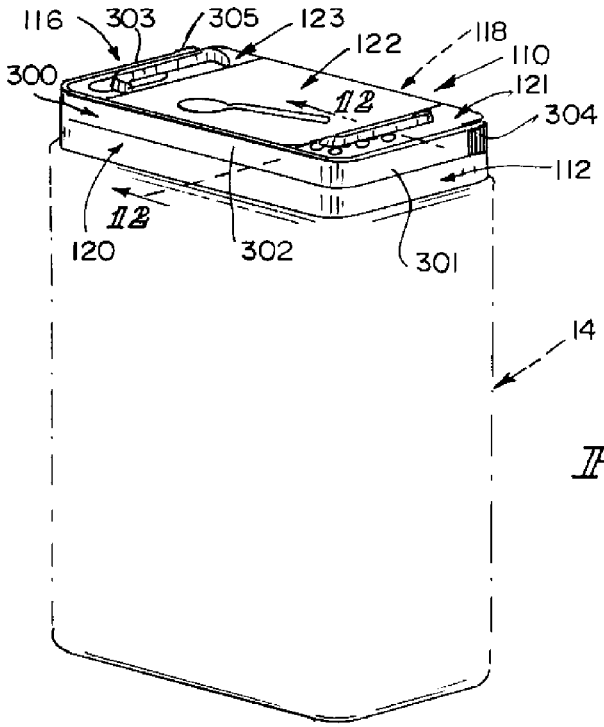
FIG. 7 is a perspective view of a closure in accordance with a second embodiment of the present disclosure and an underlying container (shown in phantom) wherein the closure is shown in a manufactured, assembled, and ready-for-sale configuration prior to removal of a removable tamper band by a consumer at first use in the manner suggested in FIG. 8.
Figure 8:
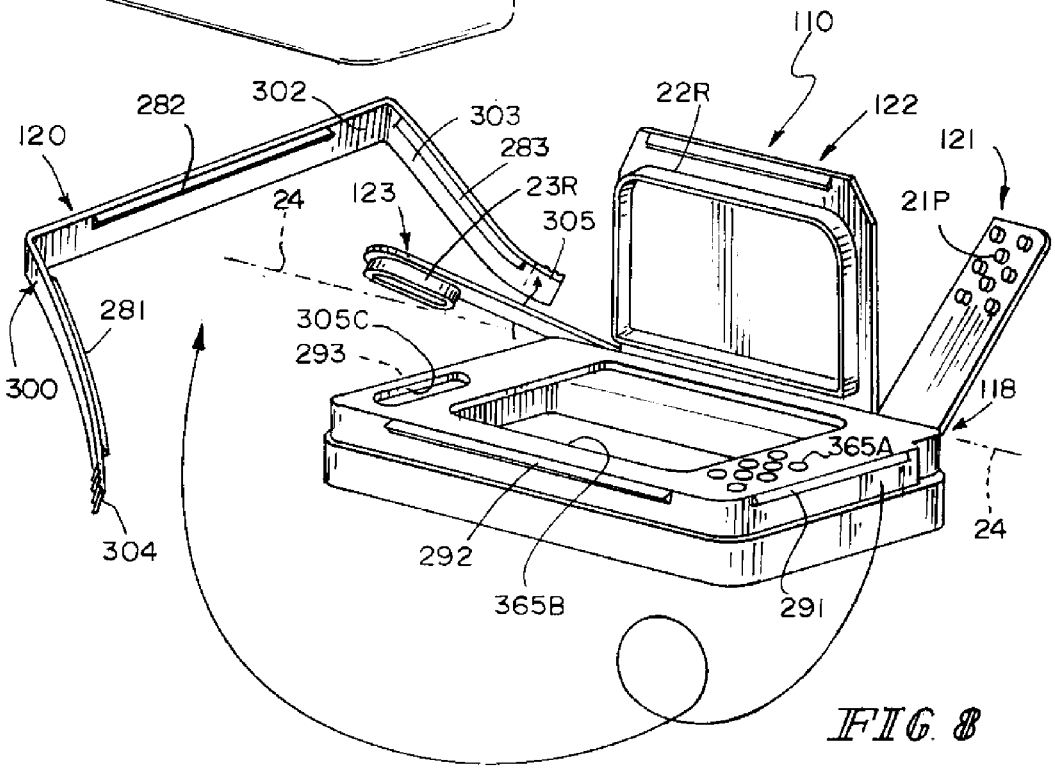
FIG. 8 is an enlarged perspective view of the closure of FIG. 7 showing a U-shaped removable tamper band after it has been removed by a consumer to free each of three flip-top caps for pivotable movement on companion hinges about a pivot axis between closed and open positions.
Figure 9:
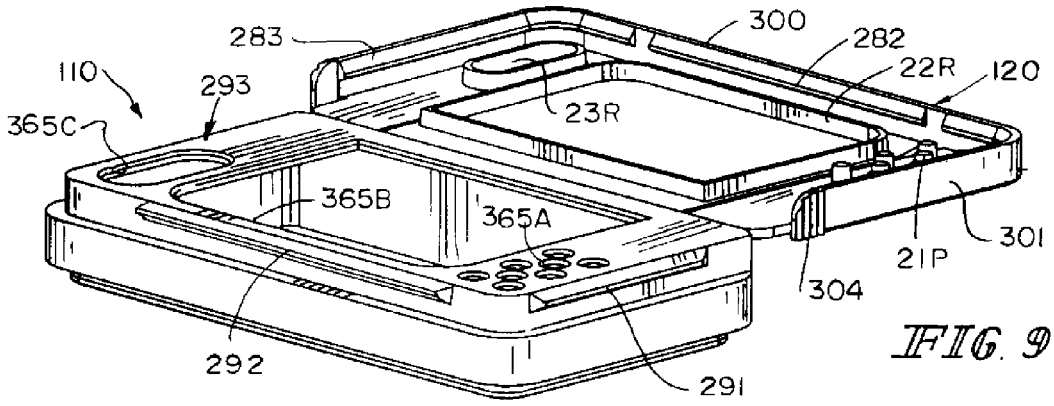
FIG. 9 is a perspective assembly view of the closure of FIGS. 7 and 8 after it has been molded at a factory and before it is assembled and installed on a companion container.
Figure 10:
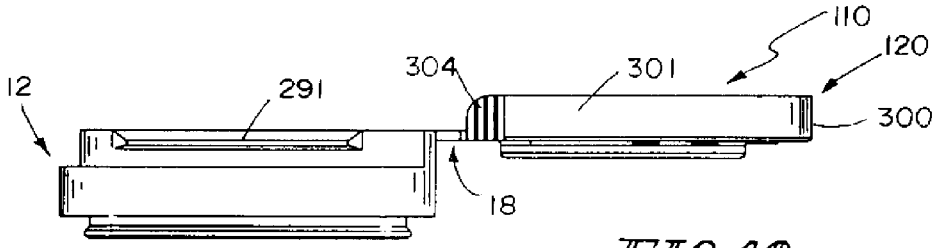
FIG. 10 is an enlarged end elevation view of the closure of FIG. 9.
Figure 11:
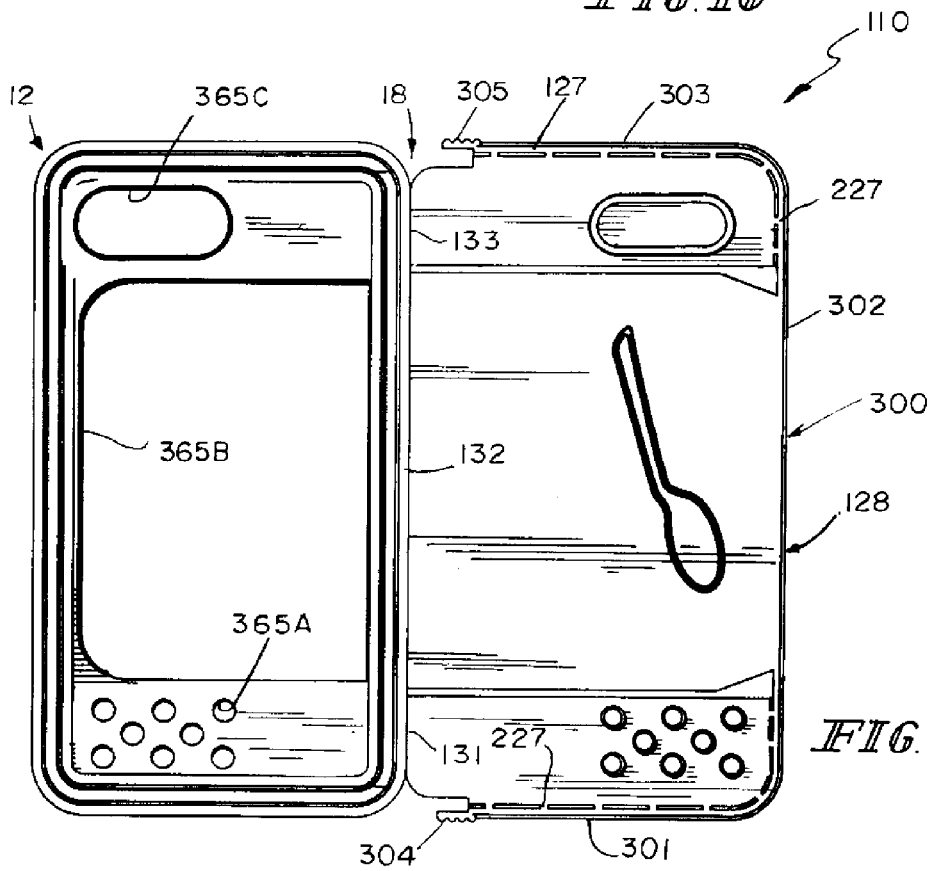
FIG. 11 is an enlarged top plan view of the closure of FIG. 9.
Figure 12:
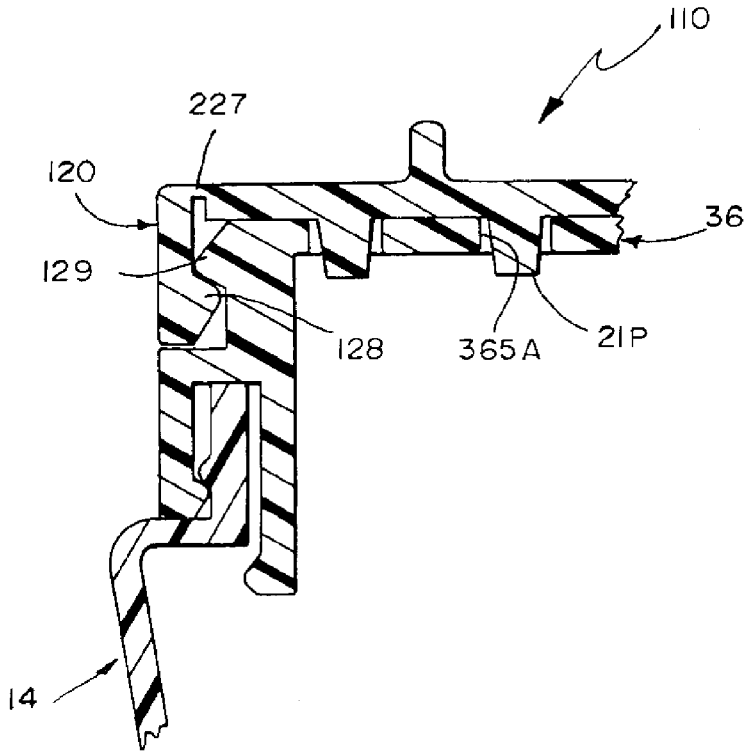
FIG. 12 is an enlarged partial sectional view taken along line 12-12 of FIG. 7.

At a factory, lid 116 is pivoted on lid tether 118 about a pivot axis 24 to move from an (as molded) unassembled spread-apart body-disengaging position shown in FIGS. 9-11 to an assembled tamper-resistant body-engaging position shown in FIG. 7. To access contents of container 14 at first use, a consumer will remove tamper band 120 in a manner suggested in FIG. 8 by breaking frangible connectors 227 (shown in FIG. 11) provided between tamper band 120 and flip-top caps 121, 122, 123 and disengaging band retainers 281, 282, 283 included in tamper band 120 from companion anchor retainers 291, 292, 293 included in body 112 as suggested in FIG. 8.

In the embodiment of FIGS. 7-12, removable tamper band 120 includes a U-shaped band strip 300, a first finger-pull tab 304 at one end of band strip 300, and a second finger-pull tab 305 at an opposite end of band strip 300 as shown, for example, in FIGS. 8, 9, and 11. Once tamper band 120 is removed, a consumer can pivot one or more of flip-top caps 121, 122, 123 about pivot axis 24 between opened and closed positions as suggested in FIG. 8. Thereafter, flip-top caps 121, 122, 123 can be releasably retained in their closed positions using interference fits as disclosed herein or in any suitable manner.

U-shaped band strip 300 includes, in series, first, second, and third sections 301, 302, and 303 as suggested in FIG. 8. First finger-pull tab 304 is coupled to a free end of first section 301. Second finger-pull tab 305 is coupled to a free end of third section 303.

First section 301 of U-shaped band strip 300 is arranged to lie alongside a side edge of first flip-top cap 121 as shown in FIGS. 9 and 11 prior to separation of tamper band 120 from first flip-top cap 121. A first band retainer 281 is coupled to first section 301 of U-shaped band strip 300 as suggested in FIG. 8.

Second section 302 of U-shaped band strip 300 is arranged to lie alongside a front edge of second flip-top cap 122 as shown in FIGS. 9 and 11 prior to separation of tamper band 120 from second flip-top cap 122. A second band retainer 282 is coupled to second section 302 of U-shaped band strip 300 as suggested in FIG. 8.

Third section 303 of U-shaped band strip 300 is arranged to lie alongside a side edge of third flip-top cap 123 as shown in FIGS. 9 and 11 prior to separation of tamper band 120 from third flip-top cap 123. A third band retainer 283 is coupled to third section 303 of U-shaped band strip 300 as suggested in FIG. 8.

The invention claimed is:

1. A tamper-evident closure for mounting on a container formed to include an interior region, the closure comprising a body adapted to mount on the container to overlie the interior region and formed to include dispensing apertures arranged to open into the interior region of the container when the body is mounted on the container, a lid including first, second, and third flip-top caps, a removable tamper band, and a frangible link arranged to couple the removable tamper band to each of the flip-top caps temporarily to cause the removable tamper band to lie in perpendicular relation to a planar top surface of each of the first, second, and third flip-top caps and to define a frangible tear line between the removable tamper band and each of the flip-top caps, and a lid tether arranged to interconnect the body and each of the flip-top caps permanently and configured to support each of the first, second, and third flip-top caps for independent movement relative to the body and to one another between a closed position covering selected ones of the dispensing apertures and an opened position exposing the selected ones of the dispensing apertures, and wherein the removable tamper band includes retainer means for engaging the body to retain each of the flip-top caps in a temporary anchored position on the body covering the dispensing apertures after movement of the lid from an unassembled spread-apart body-disengaging position alongside the body to an assembled tamper-resistant body-engaging position overlying the body until the removable tamper band is separated from the flip-top caps in response to fracture of the frangible link to free each of the flip-top caps for pivoting movement about a pivot axis associated with the lid tether between the closed and opened positions and wherein the removable tamper band is arranged to lie in spaced-apart relation to the body to locate the first, second, and third flip-top caps between the lid tether and the removable tamper band while the lid lies in the unassembled spread-apart body-disengaging position alongside the body.

2. The closure of claim 1, wherein the lid tether includes a first hinge arranged to interconnect the body and the first flip-top cap permanently, a second hinge arranged to interconnect the body and the second flip-top cap permanently, and a third hinge arranged to interconnect the body and the third flip-top cap permanently, and the removable tamper band is arranged to lie in spaced-apart relation to the body and to the first, second, and third hinges included in the lid tether when the closure is molded to cause the body, lid, and lid tether to cooperate to form a monolithic component made of a plastics material and to cause the lid to lie in the unassembled spread-apart body-disengaging position alongside the body before the unit is pivoted about the pivot axis to mate with the body to establish the temporary anchored positions of the first, second, and third flip-top caps on the body.

3. The closure of claim 2, wherein the body includes a perimeter edge arranged to surround the dispensing apertures and each of the first, second, and third hinges are coupled to the perimeter edge of the body.

4. The closure of claim 1, wherein the body includes a platform formed to include the dispensing apertures and lie in a horizontal plane, and each of the first, second, and third flip-top caps include an underside arranged to lie in the horizontal plane while the lid lies in the unassembled spread-apart body-disengaging position alongside the body and to lie in closely confronting relation to the platform while the lid lies in the assembled tamper-resistant body-engaging position overlying the body.

5. The closure of claim 1, wherein the second flip-top cap is arranged to lie between the first and third flip-top caps while the lid lies in the assembled tamper-resistant body-engaging position, the removable tamper band further includes an elongated band strip carrying the retainer means, a first finger-pull tab at one end of the elongated band strip, and a second finger-pull tab at an opposite end of the elongated band strip, each of the first and second finger-pull tabs includes an end plate and a flexible curved link interconnecting the elongated band strip and the end plate, the flexible curved link of the first finger-pull tab winds around an exterior corner of the first flip-top cap while the lid lies in the assembled tamper-resistant body-engaging position, and the flexible curved link of the second finger pull tab winds around an exterior corner of the third flip-top cap while the lid lies in the assembled tamper-resistant body-engaging position.

6. The closure of claim 1, wherein the body includes a top deck formed to include the dispensing apertures, the top deck comprises a first deck section formed to include several relatively small sprinkle-discharge dispensing apertures, a third deck section formed to include a single pour-discharge dispensing aperture, and a second deck section located between the first and third deck sections and formed to include a single scoop-receiver dispensing aperture that is larger than the single pour-discharge dispensing aperture, and the lid tether includes a first hinge coupled to the first deck section and to the first flip-top cap, a second hinge separated from the first hinge and coupled to the second deck section, and a third hinge separated from the first and second hinges and coupled to the third deck section.

7. The closure of claim 6, wherein each of the first, second, and third deck sections includes a top surface formed to include one of the dispensing apertures and an upright perimeter wall terminating at the top surface and carrying at least one retainer anchor included in the retainer means and arranged to mate with a companion band retainer included in the removable tamper band while the lid lies in the assembled tamper-resistant body-engaging position.

8. A tamper-evident closure for mounting on a container formed to include an interior region, the closure comprising a body adapted to mount on the container to overlie the interior region and formed to include dispensing apertures arranged to open into the interior region of the container when the body is mounted on the container, a lid including first, second, and third flip-top caps, a removable tamper band, and a frangible link arranged to couple the removable tamper band to each of the flip-top caps temporarily to define a frangible tear line between the removable tamper band and each of the flip-top caps, and a lid tether arranged to interconnect the body and each of the flip-top caps permanently and configured to support each of the first, second, and third flip-top caps for independent movement relative to the body and to one another between a closed position covering selected ones of the dispensing apertures and an opened position exposing the selected ones of the dispensing apertures, and wherein the removable tamper band includes retainer means for engaging the body to retain each of the flip-top caps in a temporary anchored position on the body covering the dispensing apertures after movement of the lid from an unassembled spread-apart body-disengaging position alongside the body to an assembled tamper-resistant body-engaging position overlying the body until the removable tamper band is separated from the flip-top caps in response to fracture of the frangible link to free each of the flip-top caps for pivoting movement about a pivot axis associated with the lid tether between the closed and opened positions, and wherein the removable tamper band is arranged to lie in spaced-apart relation to the body to locate the first, second, and third flip-top caps between the lid tether and the removable tamper band while the lid lies in the unassembled spread-apart body-disengaging position alongside the body, wherein the body includes a platform formed to include the dispensing apertures and lie in a horizontal plane, and each of the first, second, and third flip-top caps include an underside arranged to lie in the horizontal plane while the lid lies in the unassembled spread-apart body-disengaging position alongside the body and to lie in closely confronting relation to the platform while the lid lies in the assembled tamper-resistant body-engaging position overlying the body, and wherein the body includes an upright perimeter wall coupled to a perimeter edge of the platform and arranged to extend downwardly in a first direction away from the platform and the horizontal plane, the removable tamper band includes an elongated band strip coupled to each of the first, second, and third flip-top caps by the frangible link and arranged to extend upwardly in a second direction away from the undersides of the first, second, and third flip-top caps and the horizontal plane while the lid lies in the unassembled spread-apart body-disengaging position alongside the body.

9. The closure of claim 8, wherein the body also includes a series of retainer anchors coupled to the upright perimeter wall and the retainer means includes a series of band retainers coupled to the elongated band strip, and each of the band retainers is arranged to mate with a companion retainer anchor upon movement of the lid from the unassembled spread-apart body-disengaging position alongside the body to the assembled tamper-resistant body-engaging position overlying the platform to retain the flip-top caps in the temporary anchored positions.

10. A tamper-evident closure for mounting on a container formed to include an interior region, the closure comprising a body adapted to mount on the container to overlie the interior region and formed to include dispensing apertures arranged to open into the interior region of the container when the body is mounted on the container, a lid including first, second, and third flip-top caps, a removable tamper band, and a frangible link arranged to couple the removable tamper band to each of the flip-top caps temporarily to define a frangible tear line between the removable tamper band and each of the flip-top caps, and a lid tether arranged to interconnect the body and each of the flip-top caps permanently and configured to support each of the first, second, and third flip-top caps for independent movement relative to the body and to one another between a closed position covering selected ones of the dispensing apertures and an opened position exposing the selected ones of the dispensing apertures, and wherein the removable tamper band includes retainer means for engaging the body to retain each of the flip-top caps in a temporary anchored position on the body covering the dispensing apertures after movement of the lid from an unassembled spread-apart body-disengaging position alongside the body to an assembled tamper-resistant body-engaging position overlying the body until the removable tamper band is separated from the flip-top caps in response to fracture of the frangible link to free each of the flip-top caps for pivoting movement about a pivot axis associated with the lid tether between the closed and opened positions, wherein the removable tamper band is arranged to lie in spaced-apart relation to the body to locate the first, second, and third flip-top caps between the lid tether and the removable tamper band while the lid lies in the unassembled spread-apart body-disengaging position alongside the body, and wherein the body includes a base formed to include the dispensing apertures and adapted to mount on the container in a position covering a mouth formed in the container and configured to open into the interior region formed in the container and the body also includes retainer anchors appended to the base and arranged to extend horizontally away from the dispensing apertures and to mate with the retainer means only upon movement of the lid from the unassembled spread-apart body-disengaging position alongside the body to the assembled tamper-resistant body-engaging position overlying the body to cover the first, second, and third flip-top caps to assume the temporary anchor positions while the removable tamper band is coupled to each of the first, second, and third flip-top caps.

11. The closure of claim 10, wherein the base includes a foundation having an endless side wall and a top rim coupled to an upper end of the endless side wall and a top deck formed to include the dispensing apertures and arranged to extend upwardly away from the endless side wall, the top rim includes an outer edge coupled to the endless side wall and an inner edge coupled to the top deck, and each retainer anchor is cantilevered to an upright perimeter wall of the top deck and arranged to overlie a portion of the top rim.

12. The closure of claim 11, wherein the removable tamper band further includes an elongated band strip coupled to each of the flip-top caps by the frangible link, the retainer means includes a series of band retainers coupled to the elongated band strip, each of the band retainers is arranged to mate with a companion retainer anchor upon movement of the lid from the unassembled spread-apart body-disengaging position alongside the body to the assembled tamper-resistant body-engaging position overlying the body to retain the flip-top caps in the temporary anchored positions, and the elongated band strip is unconnected to the foundation.

13. The closure of claim 11, wherein the body also includes a first upright barrier flange arranged to extend upwardly from the top rim of the underlying foundation at a first end of the foundation to terminate at a location above the top deck and a second upright barrier flange arranged to extend upwardly from the top rim of the underlying foundation at an opposite second end of the foundation to terminate at a location above the top deck and to locate the top deck in a space provided between the first and second upright barrier flanges, the second flip-top cap is arranged to lie between the first and third flip-top caps, and the first, second, and third flip-top caps are arranged to extend into the space provided between the first and second upright barrier flanges upon movement of the lid to assume the assembled tamper-resistant body-engaging position overlying the top deck of the body to cause at least a portion of a space provided between a top side of the top deck and an underside of the first flip-top cap to be covered by the first upright barrier flange and to cause at least a portion of a space provided between the top side of the top deck and an underside of the third flip-top cap to be covered by the second upright barrier flange.

14. The closure of claim 13, wherein the removable tamper band further includes an elongated band strip coupled to each of the flip-top caps by the frangible link, the retainer means includes a series of band retainers coupled to the elongated band strip, each of the band retainers is arranged to mate with a companion retainer anchor upon movement of the lid from the unassembled spread-apart body-disengaging position alongside the body to the assembled tamper-resistant body-engaging position overlying the body to retain the flip-top caps in the temporary anchored positions, and the elongated band strip is unconnected to the foundation, the removable tamper band further includes a first finger-pull tab at one end of the elongated band strip and a second finger-pull tab at an opposite end of the elongated band strip, the elongated band strip is arranged to interconnect the first and second finger-pull tabs and carry the band retainers included in the removable tamper band, the first finger-pull tab is arranged to lie in close proximity to the first upright barrier flange and to cover another portion of the space provided between the top side of the top deck and the underside of the first flip-top cap while the lid lies in the assembled tamper-resistant body-engaging position overlying the top deck of the body, and the second finger-pull tab is arranged to lie in close proximity to the second upright barrier flange and to cover another portion of the space provided between the top side of the top deck and the underside of the third flip-top cap while the lid lies in the assembled tamper-resistant body-engaging position overlying the top deck of the body.

15. A tamper-evident closure for mounting on a container formed to include an interior region, the closure comprising a body adapted to mount on the container to overlie the interior region and formed to include dispensing apertures arranged to open into the interior region of the container when the body is mounted on the container, a lid including first, second, and third flip-top caps, a removable tamper band, and a frangible link arranged to couple the removable tamper band to each of the flip-top caps temporarily to define a frangible tear line between the removable tamper band and each of the flip-top caps, and a lid tether arranged to interconnect the body and each of the flip-top caps permanently and configured to support each of the first, second, and third flip-top caps for independent movement relative to the body and to one another between a closed position covering selected ones of the dispensing apertures and an opened position exposing the selected ones of the dispensing apertures, and wherein the removable tamper band includes retainer means for engaging the body to retain each of the flip-top caps in a temporary anchored position on the body covering the dispensing apertures after movement of the lid from an unassembled spread-apart body-disengaging position alongside the body to an assembled tamper-resistant body-engaging position overlying the body until the removable tamper band is separated from the flip-top caps in response to fracture of the frangible link to free each of the flip-top caps for pivoting movement about a pivot axis associated with the lid tether between the closed and opened positions, wherein the removable tamper band is arranged to lie in spaced-apart relation to the body to locate the first, second, and third flip-top caps between the lid tether and the removable tamper band while the lid lies in the unassembled spread-apart body-disengaging position alongside the body, wherein the second flip-top cap is arranged to lie between the first and third flip-top caps while the lid lies in the assembled tamper-resistant body-engaging position, the removable tamper band further includes an elongated band strip carrying the retainer means, a first finger-pull tab at one end of the elongated band strip, and a second finger-pull tab at an opposite end of the elongated band strip, each of the first and second finger-pull tabs includes an end plate and a flexible curved link interconnecting the elongated band strip and the end plate, the flexible curved link of the first finger-pull tab winds around an exterior corner of the first flip-top cap while the lid lies in the assembled tamper-resistant body-engaging position, and the flexible curved link of the second finger pull tab winds around an exterior corner of the third flip-top cap while the lid lies in the assembled tamper-resistant body-engaging position, and wherein the body also includes a first upright barrier flange arranged to extend upwardly from the top rim of the underlying foundation at a first end of the foundation to terminate at a location above the top deck and a second upright barrier flange arranged to extend upwardly from the top rim of the underlying foundation at an opposite second end of the foundation to terminate at a location above the top deck and to locate the top deck in a space provided between the first and second upright barrier flanges, and the first, second, and third flip-top caps are arranged to extend into the space provided between the first and second upright barrier flanges upon movement of the lid to assume the assembled tamper-resistant body-engaging position overlying the top deck of the body to cause at least a portion of a space provided between a top side of the top deck and an underside of the first flip-top cap to be covered by the first upright barrier flange and to cause at least a portion of a space provided between the top side of the top deck and an underside of the third flip-top cap to be covered by the second upright barrier flange.

16. A tamper-evident closure for mounting on a container formed to include an interior region, the closure comprising a body adapted to mount on the container to overlie the interior region and formed to include dispensing apertures arranged to open into the interior region of the container when the body is mounted on the container, a lid including first, second, and third flip-top caps, a removable tamper band, and a frangible link arranged to couple the removable tamper band to each of the flip-top caps temporarily to define a frangible tear line between the removable tamper band and each of the flip-top caps, and a lid tether arranged to interconnect the body and each of the flip-top caps permanently and configured to support each of the first, second, and third flip-top caps for independent movement relative to the body and to one another between a closed position covering selected ones of the dispensing apertures and an opened position exposing the selected ones of the dispensing apertures, and wherein the removable tamper band includes retainer means for engaging the body to retain each of the flip-top caps in a temporary anchored position on the body covering the dispensing apertures after movement of the lid from an unassembled spread-apart body-disengaging position alongside the body to an assembled tamper-resistant body-engaging position overlying the body until the removable tamper band is separated from the flip-top caps in response to fracture of the frangible link to free each of the flip-top caps for pivoting movement about a pivot axis associated with the lid tether between the closed and opened positions, and wherein the removable tamper band is arranged to lie in spaced-apart relation to the body to locate the first, second, and third flip-top caps between the lid tether and the removable tamper band while the lid lies in the unassembled spread-apart body-disengaging position alongside the body, wherein the second flip-top cap is arranged to lie between the first and third flip-top caps while the lid lies in the assembled tamper-resistant body-engaging position, the removable tamper band further includes an elongated band strip carrying the retainer means, a first finger-pull tab at one end of the elongated band strip, and a second finger-pull tab at an opposite end of the elongated band strip, each of the first and second finger-pull tabs includes an end plate and a flexible curved link interconnecting the elongated band strip and the end plate, the flexible curved link of the first finger-pull tab winds around an exterior corner of the first flip-top cap while the lid lies in the assembled tamper-resistant body-engaging position, and the flexible curved link of the second finger pull tab winds around an exterior corner of the third flip-top cap while the lid lies in the assembled tamper-resistant body-engaging position, and wherein the retainer means includes a series of band retainers coupled to the elongated band strip, each of the band retainers is arranged to mate with a companion retainer anchor upon movement of the lid from the unassembled spread-apart body-disengaging position alongside the body to the assembled tamper-resistant body-engaging position overlying the body to retain the flip-top caps in the temporary anchored positions, the end plate of the first finger-pull tab is arranged to lie in close proximity to the first upright barrier flange and to cover another portion of the space provided between the top side of the top deck and the underside of the first flip-top cap while the lid lies in the assembled tamper-resistant body-engaging position overlying the top deck of the body, and the end plate of the second finger-pull tab is arranged to lie in close proximity to the second upright barrier flange and to cover another portion of the space provided between the top side of the top deck and the underside of the third flip-top cap while the lid lies in the assembled tamper-resistant body-engaging position overlying the top deck of the body.

17. A tamper-evident closure for mounting on a container formed to include an interior region, the closure comprising a body adapted to mount on the container to overlie the interior region and formed to include dispensing apertures arranged to open into the interior region of the container when the body is mounted on the container, a first aperture cover including a first flip-top cap and a first hinge coupled to the first flip-top cap and to the body to support the first flip-top cap for movement about a pivot axis between a closed position covering a first of the dispensing apertures to an opened position away from the body uncovering the first of the dispensing apertures, a second aperture cover including a second flip-top cap and a second hinge coupled to the second flip-top cap and to the body to support the second flip-top cap for movement about the pivot axis between a closed position covering a second of the dispensing apertures to an opened position away from the body uncovering the second of the dispensing apertures, a cap-motion blocker coupled to each of the first and second flip-top caps along separate first and second frangible tear lines and mated to the body to block movement of each of the first and second flip-top caps about the pivot axis from the closed positions to the opened positions as long as the cap-motion blocker is coupled to the first and second flip-top caps along the first and second frangible tear lines, and wherein the body includes a foundation adapted to mate with the container, a top deck formed to include the dispensing apertures and coupled to the foundation and to each of the first and second hinges, and a series of retainer anchors appended to an upright perimeter wall included in the top deck to extend horizontally away from the dispersing apertures and arranged to mate with companion band retainers included in the cap-motion blocker to establish means for temporarily retaining the first and second flip-top caps in the closed positions covering the dispensing apertures formed in the top deck until the first and second frangible tear lines are broken to decouple the cap-motion blocker from the first and second flip-top caps.

18. The closure of claim 17, wherein the foundation includes an endless side wall adapted to mate with the container so as to support the body in a position covering a mouth formed in the container and configured to open into an interior region formed in the container and a top rim coupled to a top portion of the endless side wall at an outer edge thereof and to the upright perimeter wall of the top deck at an inner edge thereof, and the retainer anchors are arranged to lie above and in spaced-apart relation to the top rim of the foundation.

19. A tamper-evident closure for mounting on a container formed to include an interior region, the closure comprising a body adapted to mount on the container to overlie the interior region and formed to include dispensing apertures arranged to open into the interior region of the container when the body is mounted on the container, a lid including first, second, and third flip-top caps, a removable tamper band, and a frangible link arranged to couple the removable tamper band to each of the flip-top caps temporarily to define a frangible tear line between the removable tamper band and each of the flip-top caps, and a lid tether arranged to interconnect the body and each of the flip-top caps permanently and configured to support each of the first, second, and third flip-top caps for independent movement relative to the body and to one another between a closed position covering selected ones of the dispensing apertures and an opened position exposing the selected ones of the dispensing apertures, and wherein the removable tamper band includes retainer means for engaging the body to retain each of the flip-top caps in a temporary anchored position on the body covering the dispensing apertures after movement of the lid from an unassembled spread-apart body-disengaging position alongside the body to an assembled tamper-resistant body-engaging position overlying the body until the removable tamper band is separated from the flip-top caps in response to fracture of the frangible link to free each of the flip-top caps for pivoting movement about a pivot axis associated with the lid tether between the closed and opened positions wherein the removable tamper band is arranged to lie in spaced-apart relation to the body to locate the first, second, and third flip-top caps between the lid tether and the removable tamper band while the lid lies in the unassembled spread-apart body-disengaging position alongside the body and wherein the body includes an endless side wall and a top deck arranged to meet the endless side wall along a rear edge of the body and formed to include the dispensing apertures, the top deck comprises a first deck section formed to include several relatively small sprinkle-discharge dispensing apertures, a third deck section formed to include a single pour-discharge dispensing aperture, and a second deck section located between the first and third deck sections and formed to include a single scoop-receiver dispensing aperture that is larger than the single pour-discharge dispensing aperture, and the lid tether includes a first hinge coupled to the first deck section at the rear edge of the body and to the first flip-top cap, a second hinge separated from the first hinge and coupled to the second deck section at the rear edge of the body, and a third hinge separated from the first and second hinges and coupled to the third deck section at the rear edge of the body.

* * * * *